US006116419A

United States Patent [19]

Campagna et al.

[11] Patent Number: 6,116,419

[45] Date of Patent: Sep. 12, 2000

[54] LADDER POUCH

[76] Inventors: Paul Campagna, 328 Bolivar St., Canton, Mass. 02021; Francis Petit DeMange, 412 Page St., Stoughton, Mass. 02072

[21] Appl. No.: 09/301,173

[22] Filed: Apr. 28, 1999

[51] Int. Cl.[7] ..... B65D 85/28

[52] U.S. Cl. ..... 206/373; 224/901.2; 182/129

[58] Field of Search ..... 206/349, 372, 206/373; 248/210, 238; 182/129; 383/39, 40; 224/901.2, 901.6

[56] References Cited

U.S. PATENT DOCUMENTS

| | | | |
|---|---|---|---|
| D. 317,206 | 5/1991 | Cagle | D25/68 |
| D. 347,115 | 5/1994 | Breedlove . | |
| D. 412,616 | 8/1999 | Livingston . | |
| 1,171,896 | 2/1916 | Simpson . | |
| 4,069,954 | 1/1978 | Rauch . | |
| 4,484,367 | 11/1984 | Jenkins . | |
| 4,706,918 | 11/1987 | Wilson | 248/210 |
| 4,773,535 | 9/1988 | Cook | 206/373 |
| 4,804,121 | 2/1989 | Stanton et al. | 224/901 |
| 4,880,315 | 11/1989 | Berry et al. | 383/39 |
| 5,269,410 | 12/1993 | Abregano | 206/315.5 |
| 5,337,933 | 8/1994 | Nuez | 224/151 |
| 5,370,246 | 12/1994 | Traynor | 383/39 |
| 5,638,915 | 6/1997 | Hardy | 182/129 |
| 5,639,003 | 6/1997 | Utzinger, III | 224/577 |
| 5,647,453 | 7/1997 | Cassells | 189/129 |
| 5,758,972 | 6/1998 | Mack et al. | 383/11 |

*Primary Examiner*—David T. Fidei
*Attorney, Agent, or Firm*—Gunster, Yoakley & Stewart, P.A.

[57] ABSTRACT

A ladder pouch includes an elongate, flexible sheet having a first end, a midpoint, a second end, a first side, and a second side. A first engagement structure, such as hook and pile fastening material, is located on the first side of the elongate, flexible sheet between the midpoint and the first end. A second engagement structure, complimentary with the first engagement structure is located on the second side of the sheet proximate its second end. Multiple pockets are disposed on or integral with the first side of the sheet. The pockets can be open-mouthed or include covering flaps.

6 Claims, 5 Drawing Sheets

LADDER POUCH

CROSS-REFERENCE TO RELATED APPLICATIONS

Not applicable.

STATEMENT REGARDING FEDERALLY SPONSORED RESEARCH

Not applicable.

FIELD OF THE INVENTION

The present invention relates to a ladder accessory.

BACKGROUND OF THE INVENTION

Ladders are routinely used to access areas that are above standing height. They frequently serve as work platforms. Anyone who has used a ladder is well aware that even the slightest body movements of a person perched a ladder can cause objects placed on the ladder top (if flat), fold out shelf (if present) or rung (if flat) to tumble from the ladder to the ground. A well-worn comedy scene immediately comes to mind, wherein a can of paint falls from a ladder onto someone's head.

Although movies sometimes regarding an object's fall as a humorous event, the reality of falling objects is rarely funny. Not only can falling objects such as heavy or sharp tools injure bystanders, but the person on the ladder can lose his or her balance in an attempt to catch falling, or about to fall objects. Even if the ladder user remains on the ladder, he or she does not do so for long, because he or she must descend the ladder, collect the object(s) and re-climb the ladder. Climbing up and down a ladder 10, 20, or 30 feet can be exhausting, especially if done repeatedly, and it is certainly a frustrating waste of time.

A short, six-foot utility or step-ladder having a flat top, flat steps, and a fold-out tray provides some space for placing objects. However, when it is time to move the ladder to an adjacent work area, usually everything falls off of the ladder. An attempt to overcome the problem of tool storage is illustrated in U.S. Pat. No. Des. 317,206, wherein a tool holder having two large pockets is fitted over the top of a standard, utility ladder. The disclosed tool holder, however, cannot be used or adapted for use at another location on the ladder other than the top; and it cannot be used in association with a common extension ladder. Further, thin objects like screwdrivers can fall into the pockets making them hard to identify and grasp if multiple objects are in the pockets.

An attempt to overcome the challenges associated with tool carriage on an extension ladder is shown in U.S. Pat. No. 4,706,918, wherein a two-part bucket is balanced on a rung. Although a flange is provided to help stabilize the bucket, it only does so in one direction. Thus, if the weight distribution between the two sides of the bucket becomes uneven, the bucket could easily flip off of the ladder. Further, the protruding bucket sides make it difficult to lean against the ladder for body support, even if the ladder user is unconcerned with ejecting the contents of the bucket. Also, the upwardly extending handle and the protruding bucket sides render two rungs of the ladder inaccessible.

SUMMARY OF THE INVENTION

The present invention improves upon known ladder accessories for tool carriage by providing a ladder pouch that conveniently carries a large number of objects, such as tools and supplies, in a manner that greatly reduces the possibility of falling objects, both while the ladder is stationary and when the ladder is being moved between work locations.

In an exemplary embodiment, the ladder pouch includes an elongate, flexible sheet having a first end, a midpoint, a second end, a first side, and a second side. A first engagement structure, such as hook and pile fastening material, is located on the first side of the elongate, flexible sheet between the midpoint and the first end. A second engagement structure, complimentary with the first engagement structure is located on the second side of the sheet proximate its second end. Multiple pockets are disposed on or integral with the first side of the sheet. The pockets can be open-mouthed or include covering flaps.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE DRAWINGS

Figure 1:
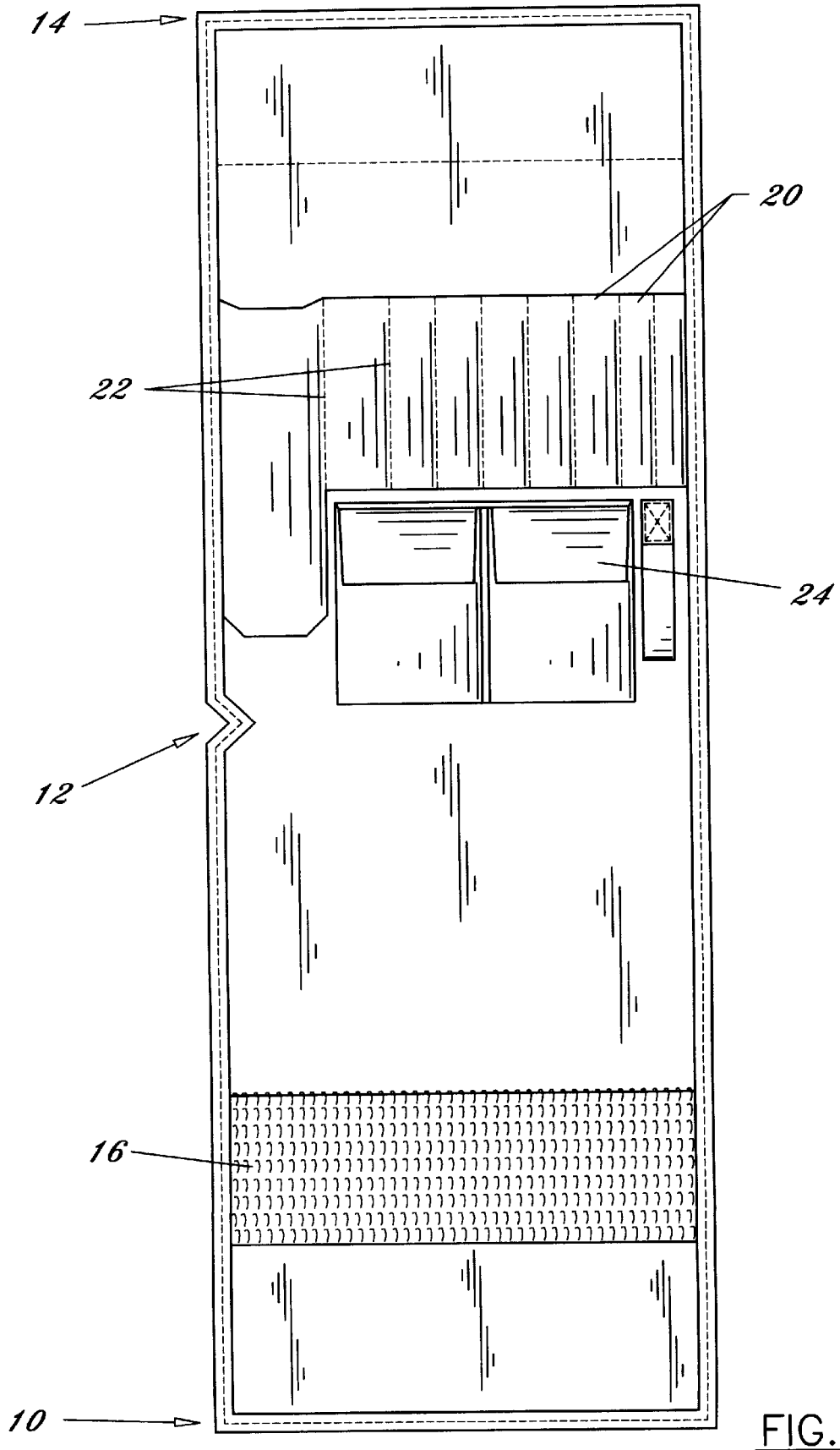
FIG. 1 is a plan view of a first side of a ladder pouch in accordance with the invention.

FIG. 1 illustrates the first side of a ladder pouch in accordance with the present invention. The pouch includes an elongate, flexible sheet, such as PVC coated denier polyester fabric. The pouch has a first end 10, a midpoint 12, and a second end 14. The second, opposite side of the pouch is shown in FIG. 3.

A first engagement structure 16 is located on the first side of the elongate, flexible sheet between the midpoint 12 and the first end 10. In the illustrated embodiment, the first engagement structure includes hook and pile fastener material (either the hook material or the pile material). To enhance versatility, the fastener material can cover an extensive region of the first side of the elongate, flexible sheet. However, an approximately 4 inch by 12 inch strip of material extending across the sheet is suitable for most applications for a pouch that is about 13 inches wide.

Figure 3:
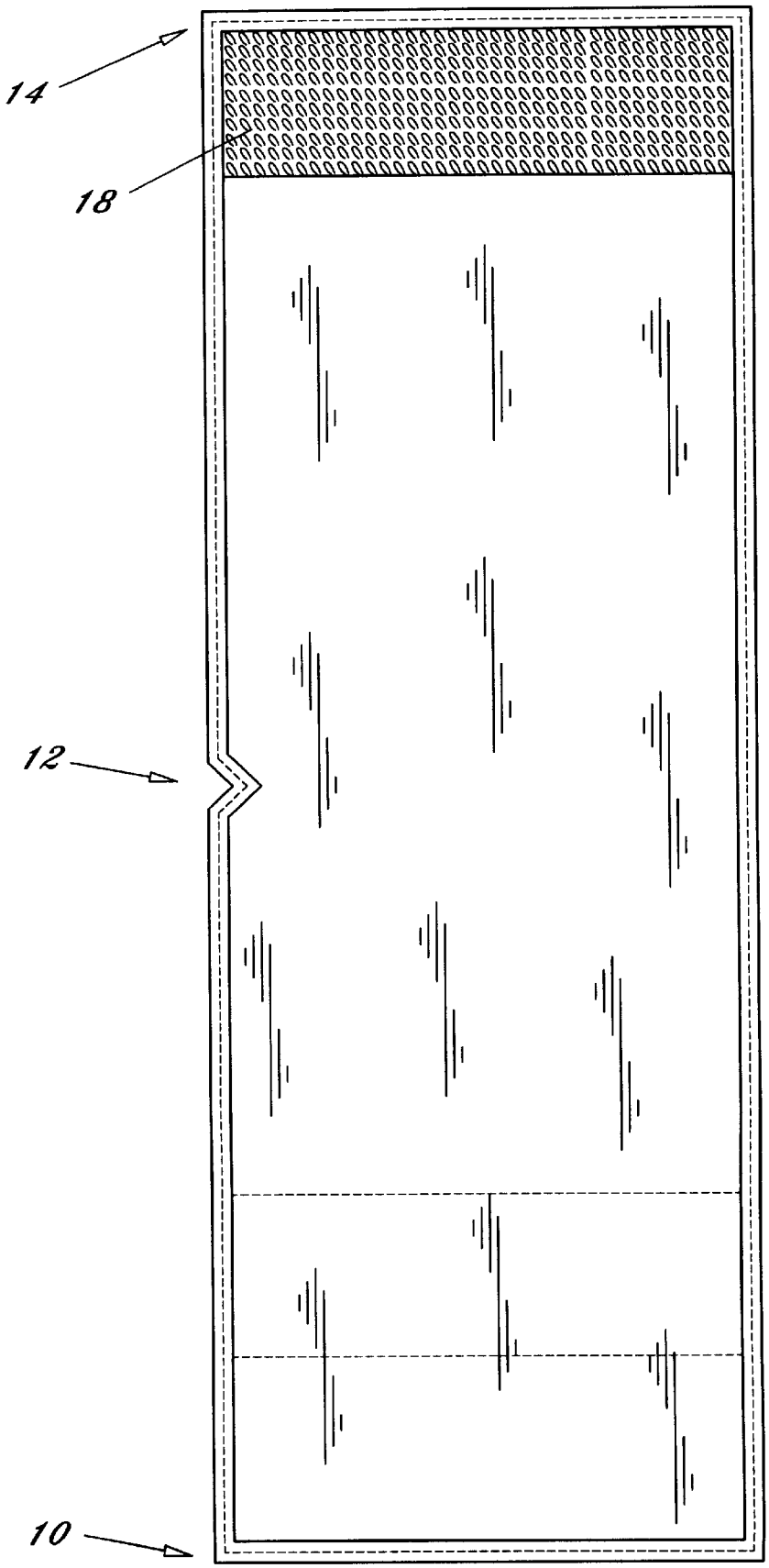
FIG. 3 is a plan view of a second side of the ladder pouch, opposite the first side illustrated in FIG. 1.

As shown in FIG. 3, a second engagement structure 18 is located on the second side of the elongate, flexible sheet proximate the second end 14. The second engagement structure 18 is complimentary with the first engagement structure 16 so as to be matably engagable therewith. In the illustrated embodiment, the second engagement structure 18 includes hook and pile fastener material (either the hook material or the pile material).

Thus, if the first engagement structure 16 includes hook material, then the second engagement structure 18 would include pile material. Conversely, if the first engagement structure 16 includes pile material, then the second engagement structure 18 would include hook material. Although the fastener material can cover an extensive region of the second side of the elongate, flexible sheet, in the illustrated embodiment the material is an approximately 4 inch strip that extends about 12 inches across the sheet near the second end 14 of the sheet.

Figure 2:
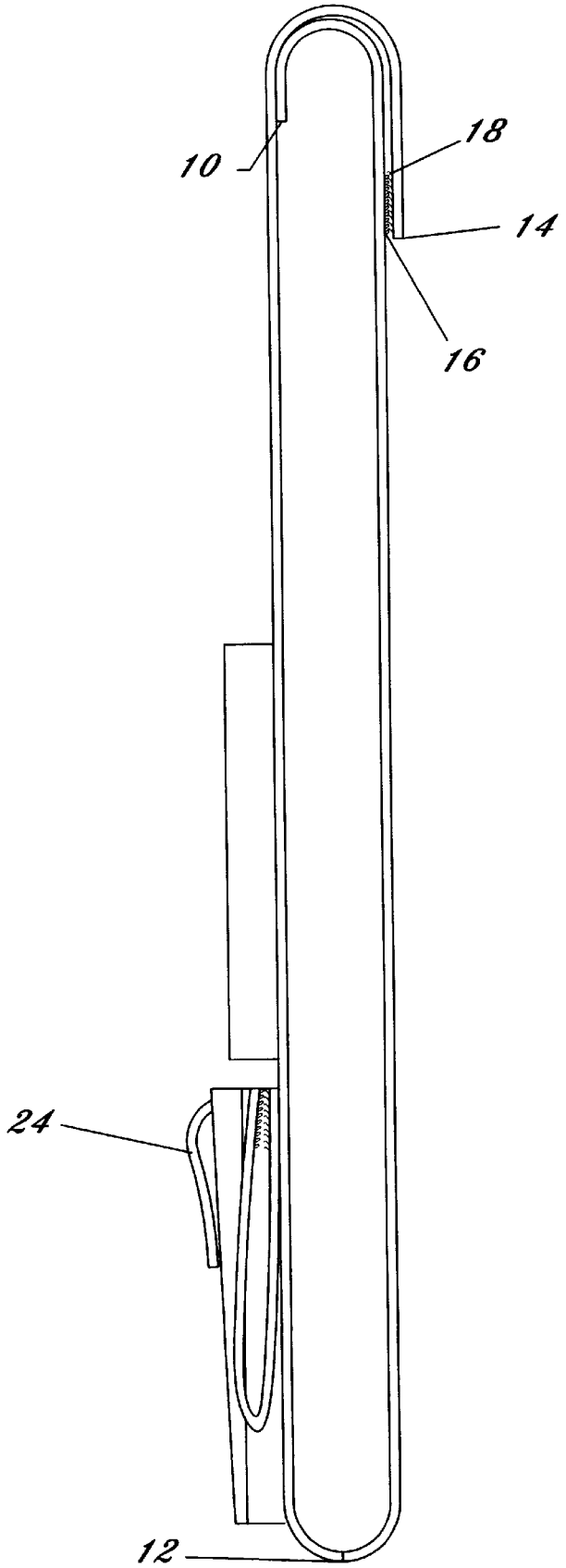
FIG. 2 is a side view of the ladder pouch shown in FIG. 1, wherein the ladder pouch is shown in a loop configuration.

As shown in FIG. 2, when the elongate, flexible sheet is formed into a loop, the first and second engagement structures 16 and 18, respectively, are in matable opposition.

Referring to FIGS. 1 and 2, pockets 20 formed, disposed, or integral with the first side of the elongate, flexible sheet are shown. Stitching 22 between pockets 20 and along edge seams is shown as dashed lines.

Figure 4:
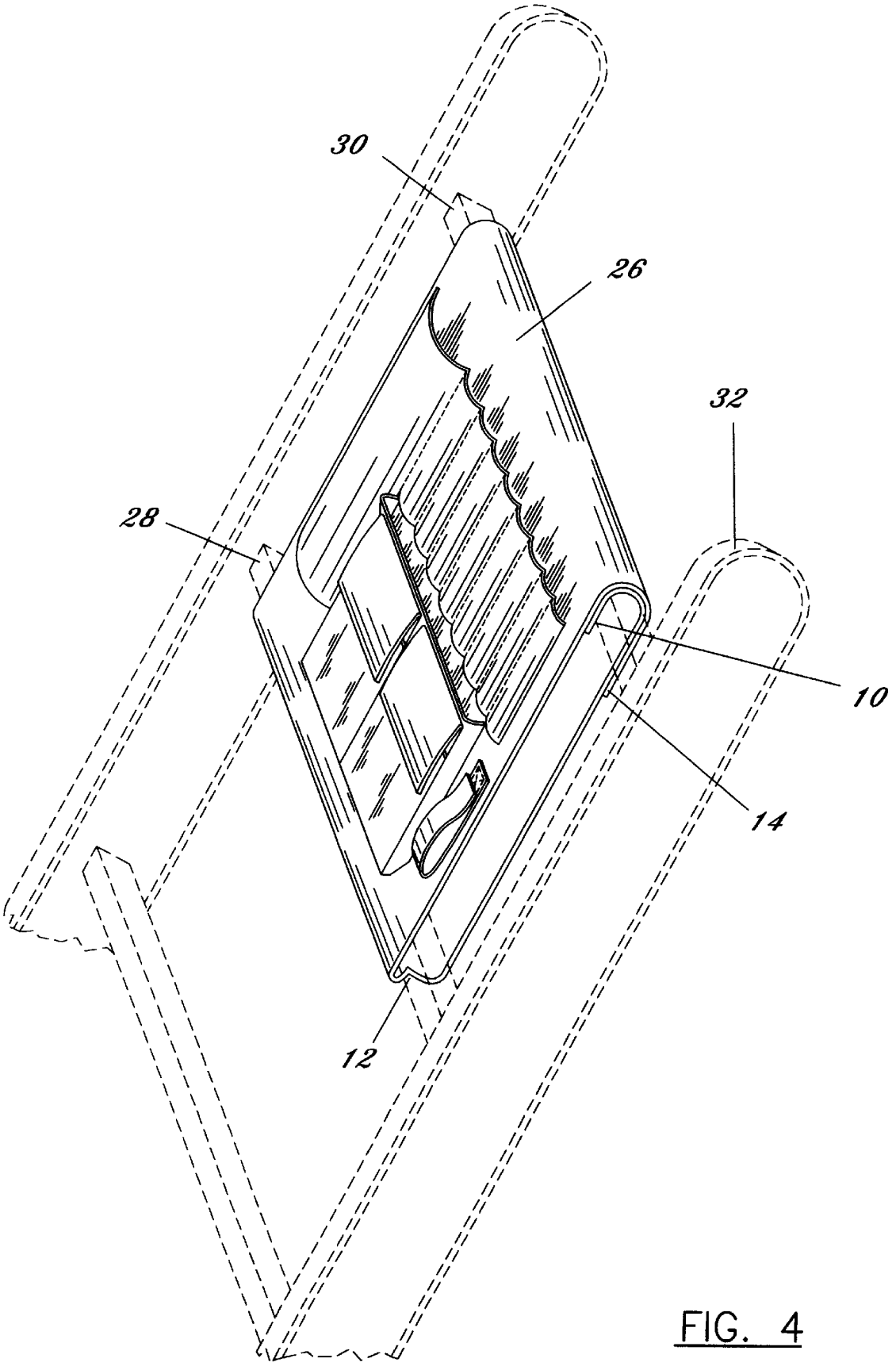
FIG. 4 is a perspective view of the ladder pouch mated to an extension ladder that is shown in phantom.

As shown more clearly in FIG. 4, at least some of the pockets define an opening that faces away from the midpoint 12 of the elongate, flexible sheet. However, in other embodiments, one or more pockets define an opening that faces toward the midpoint of the elongate, flexible sheet. A pocket 20 can be provided with a flap 24 to cover the opening of the pocket. Depending upon the orientation of the pocket openings, the midpoint 12 of the sheet is either at the top or the bottom of an installed pouch.

FIG. 4 illustrates an exemplary ladder pouch 26 secured to adjacent rungs 28 and 30 at the top of an extension ladder, wherein the midpoint 12 of the pouch is roughly centered on the bottom rung. As shown in FIGS. 1, 3 and 4, the midpoint 12 of the pouch can include a notch (area of reduced width) that reduces the transverse dimension of the pouch, thus exposing a greater portion of the rung. This feature allows, for example, a hook for a can of paint (not shown) to be suspended from the rung without damaging the pouch.

Ladders have a distance between rungs, from center to center, of about 12 inches. Thus, an exemplary flexible sheet is greater than 24 inches long, and more preferably about 36 inches long. With strips of hook and pile fastening material as described above, the pouch will accommodate minor variations in rung spacing or bent rungs. Although the sheet could be 40 or more inches long, a 36 inch length is not only effective, but it also facilitates fabrication from readily available materials. The wide strips of hook and pile fastening material allow mating of the ends of the pouch at other than a single, precise location, yet allow the pouch to be tightly and securely fastened to the ladder.

Figure 5:
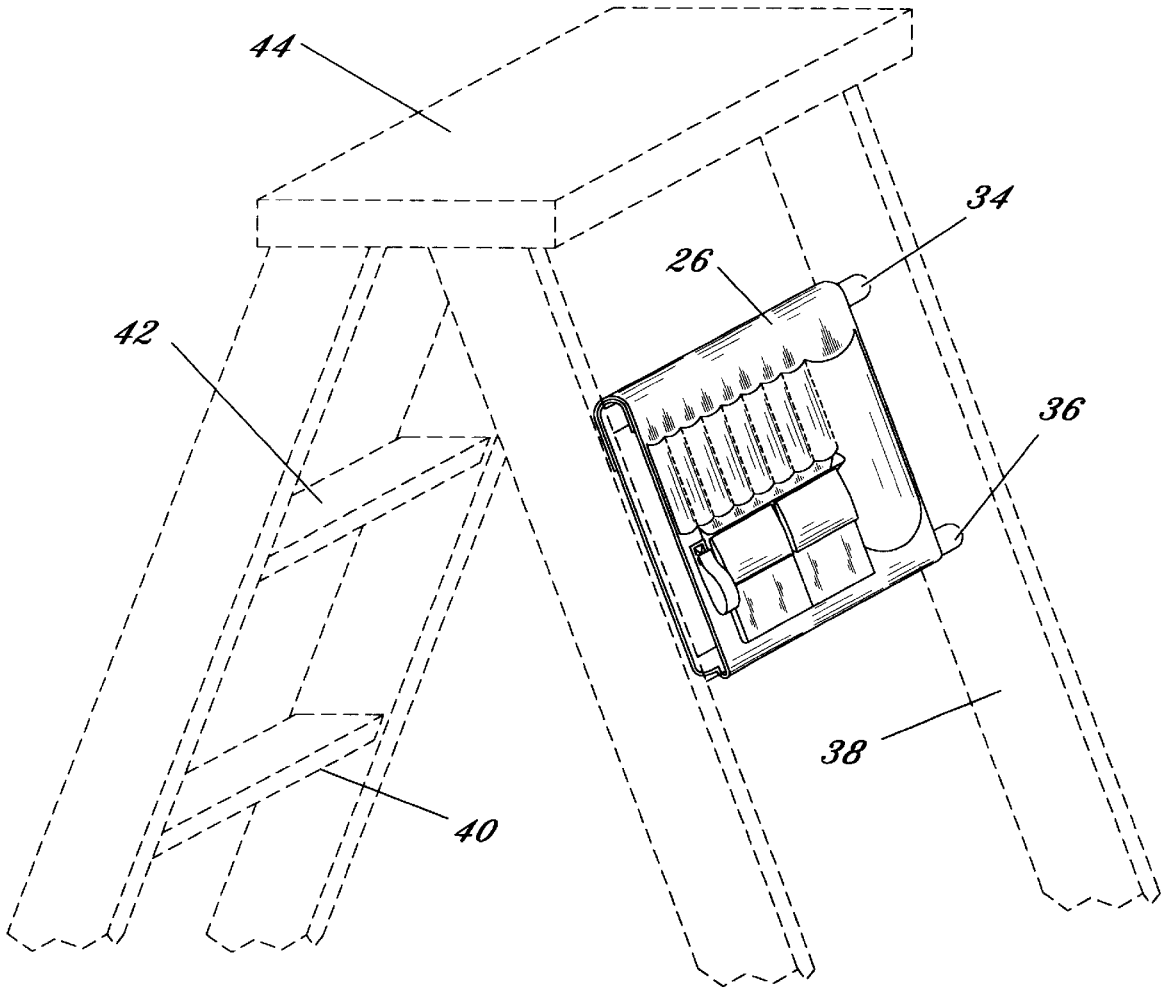
FIG. 5 is a perspective view of the ladder pouch mated to a step ladder that is shown in phantom.

FIG. 5 illustrates the pouch 26 installed between cross-supports 34 and 36 of a step-ladder 38. In this illustration, it should be evident that the pouch 26 in no way obstructs either the flat steps 40 and 42, or the ladder top 44.

In use, tools and supplies can be stored in discrete, yet easily accessible pockets. Although reasonable care is always required when working with ladders, a ladder with a pouch secured thereto can be moved about with a reasonable assurance that objects properly stowed in the pouch will not tumble.

It will be appreciated by persons skilled in the art that the present invention is not limited to what has been particularly shown and described herein above. A variety of modifications and variations are possible in light of the above teachings without departing from the scope and spirit of the invention, which is limited only by the following claims.

What is claimed is:

1. A pouch and ladder combination comprising:

a ladder including a plurality of parallel rungs; and a pouch including an elongate, flexible sheet having a first end, a midpoint, a second end, a first side, and a second side;

a first engagement structure located on the first side of the elongate, flexible sheet between the midpoint and the first end;

a second engagement structure located on the second side of the elongate, flexible sheet proximate the second end;

a plurality of pockets provided on the first side of the elongate flexible sheet; and a pair of opposing notches at the midpoint of the elongate, flexible sheet;

wherein the pouch is wrapped around two or more rungs to encircle them, so that the plurality of pockets are outwardly facing, the first engagement structure is engaged with the second engagement structure, and the midpoint of the elongate flexible sheet is substantially centered on one rung of the two or more rungs that are encircled by the pouch.

2. The pouch of claim 1, wherein at least some of the pockets define an opening that faces toward the midpoint of the elongate, flexible sheet.

3. The pouch of claim 1, wherein at least some of the pockets define an opening that faces away from the midpoint of the elongate, flexible sheet.

4. The pouch of claim 1, wherein the elongate, flexible sheet is between 24 and 40 inches in length.

5. The pouch of claim 1, wherein the first and second engagement structures include hook and pile fastening material.

6. The pouch of claim 1, further comprising multiple rows of pockets.

* * * * *